United States Patent [19]

Wolk et al.

[11] 3,964,995

[45] June 22, 1976

[54] HYDRODESULFURIZATION PROCESS

[75] Inventors: Ronald H. Wolk, Lawrence Township, Mercer County; Seymour B. Alpert, Princeton; Michael C. Chervenak, Pennington, all of N.J.

[73] Assignee: Hydrocarbon Research, Inc., Morristown, N.J.

[22] Filed: June 21, 1974

[21] Appl. No.: 481,797

Related U.S. Application Data

[63] Continuation of Ser. No. 274,221, July 24, 1972, abandoned, Continuation of Ser. No. 56,617, July 20, 1970, abandoned.

[52] U.S. Cl. ..... 208/210; 208/251 H

[51] Int. Cl.[2] ..... C10G 23/02

[58] Field of Search ..... 208/210, 213, 211, 251 H

[56] References Cited

UNITED STATES PATENTS

| | | | |
|---|---|---|---|
| 2,730,487 | 1/1956 | Porter et al. | 208/211 |
| 2,771,401 | 11/1956 | Shepherd | 208/210 |
| 3,725,251 | 4/1973 | Alpert et al. | 208/210 |
| 3,901,792 | 8/1975 | Wolk et al. | 208/210 |

*Primary Examiner*—Delbert E. Gantz
*Assistant Examiner*—G. J. Crasanakis

[57] ABSTRACT

A two-stage hydrodesulfurization process for a 65 to 80 percent desulfurization of a high metal content residuum, such as those obtained from Venezuela, in which the contact solids activity in both stages is maintained at an equilibrium level by constant replacement of the contact solids in both stages. The first stage contains a porous alumina solids contact material activated with at least one promoter oxide selected from $Fe_2O_3$, $TiO_2$ and $SiO_2$, which has as its primary purpose the removal of vanadium and nickel from the feed material. However, the treatment of the feed in the first stage was found to improve the second stage performance by a factor greater than the amount of metals removed. The second stage contains a highly active desulfurization catalyst of limited porosity.

4 Claims, 7 Drawing Figures

FIG. 1
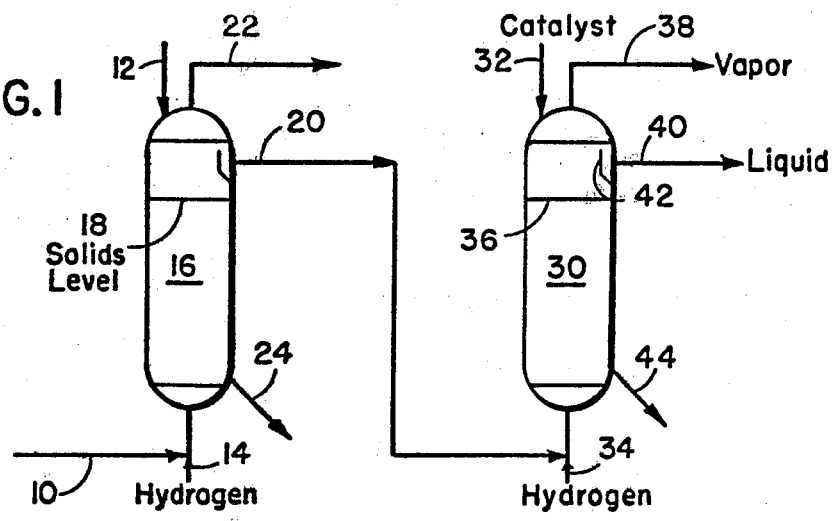
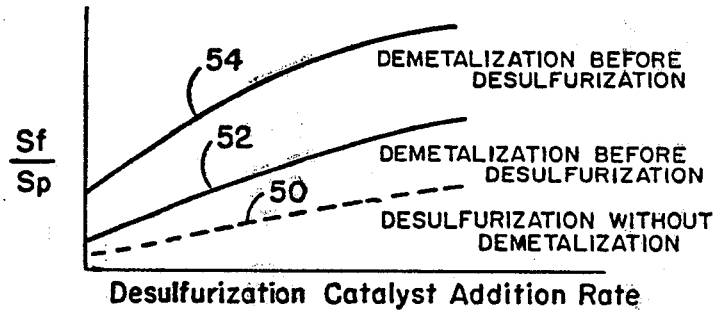
FIG. 2
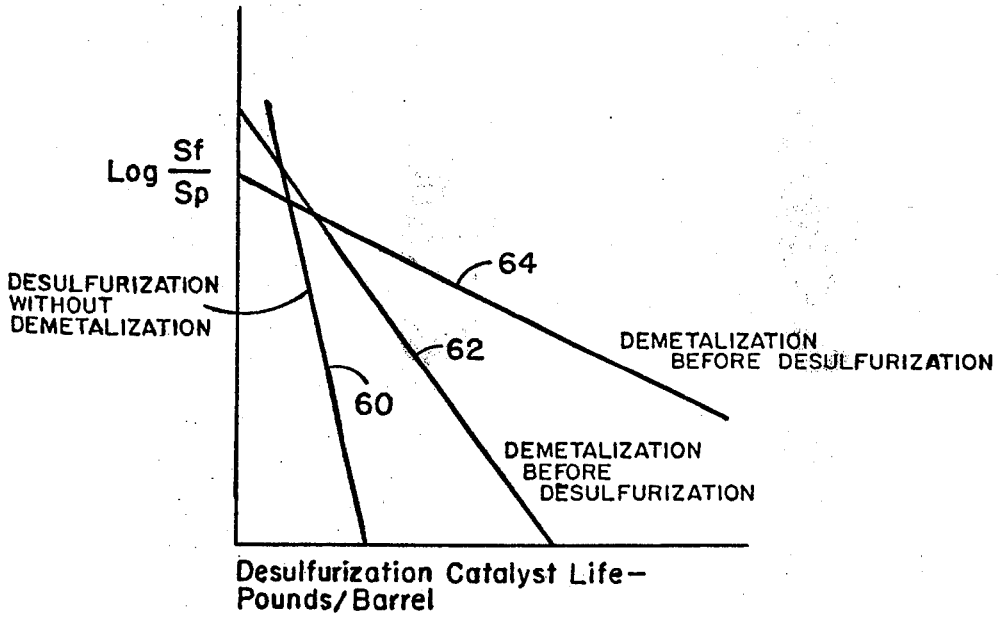
FIG. 3

HYDRODESULFURIZATION PROCESS

This is a continuation of application Ser. No. 274,221, filed July 24, 1972, and Ser. No. 56,617, filed July 20, 1970, both abandoned.

BACKGROUND OF THE INVENTION

The operating costs for desulfurization of high metal containing pertroleum oils are higher than economically feasible because of the rapid poisioning of the hydrodesulfurization catalyst. The high metals feeds mentioned here as characterized by Venezuelan stocks usually contain 100 to 400 parts per million of vanadium in the atmospheric residuum obtained from the crudes. The life of the desulfurization contact solids is limited by metals deposition in the pore structure of the solids. Attempts have been made to use high porosity catalysts as contact solids which are characteristically low in activity but do not produce the 0.5 to 1.0 weight percent sulfur fuel oils that the pollution regulations currently being promulgated require. On the other hand, high activity catalysts, used as the contact solids, which are effective in meeting these objectives have a very limited catalyst life because of blockage of the catalyst pores. It has been well known in the art, that contact with material such as bauxite is an effective means of removing vanadium from residual oils. Unfortunately, the reaction rate is quite low and the size of the pretreatment reactor becomes extremely large in regard to the catalytic reactor and thereby raises the capital cost of the facility to an uneonomic level.

Other previous work, mainly U.S. Pat. Nos. 2,987,467 and 3,151,060 also treat the metals containing petroleum stock by first stage hydrocracking. The method disclosed, however, is carried out at relatively high temperatures and results in much higher hydrogen consumption than the presently disclosed invention. Reduction of hydrogen consumption and improving hydrogen selectivity are very important economic parameters in the desulfurization of residual oils.

One of the great difficulties in the desulfurization of Venezuelan residuum is that the asphaltenic compounds contained in the resid are of a type that are difficult to desulfurize. In addition, the high vanadium content present in those asphaltenic structures acts as a contact solids poison which acts primarily by blocking up the pores near the external surface of the contact solids so that the internal surface becomes unavailable to carry out the desulfurization reaction. We have discovered a technique for pretreating the feedstock in a first stage prior to contacting it with a high active catalyst used as the contact solids, which allows the highly active catalyst to reach desulfurization levels of from 65 to 80 percent at reasonable space velocities and at a reasonable catalyst cost. Previously, all work on this kind of resid had to be carried out with a very porous catalyst which is quite amenable to poisoning by reaction of the metals with the active sites. Although it is simple enough to obtain 50 percent desulfurization of Venezuelan stocks, there is little economic interest in doing so. The new pollution laws being promulgated require at least 65 to 80 percent desulfurization to meet the specifications being placed on the fuel oils burned in metropolitan areas. These desired desulfurization levels can be reached economically by means of this invention.

SUMMARY OF THE INVENTION

It has been found that by maintaining an ebullated bed in both contact solids reactors and constantly adding contact solids to those reactors the activity of the second stage contact solids and the type of contact solids used are such that economic desulfurization at desired levels of Venezuelan residuals is feasible. Additionally, it was discovered in this invention that an unexpected reduction in hydrogen consumption and improved selectivity was obtained by using in the first stage reactor a high replacement rate of porous alumina solids such as bauxite or alumina precipitated from aluminium hydroxide gels. This improvement came about as a result of the reduction in the amount of cracking of the residual oil to remove the metals. In this invention because of the effectiveness of high replacement rates of first stage contact solids, metals removal can be maintained at the desired level without resorting to high temperatures. These materials are quite effective for removing metals such as vanadium and nickel from the feedstock. By replacement of first stage contact solids at a rate determined by the desired operating parameters, the metal content of the oil leaving the first stage can be maintained at a constant level. In the second stage, a catalyst used as the contact solids, having an extremely high activity and limited pore structure which is susceptible to metals blockage, can be used because the feed from the first stage is much lower in metals than the normal feed would be. Here again, catalyst activity can be maintained at a desired level by constant replacement of the second stage catalyst at such a rate to maintain the desired level of desulfurization. The concept of the ebullated bed is disclosed in U.S. Pat. Re. No. 25,770.

DESCRIPTION OF THE DRAWINGS

FIG. 1 is a diagrammatic view of a two stage ebullated bed system for desulfurizing a high metals containing feed.

FIG. 2 is a graph generally showing the catalyst addition rate required to accomplish sulfur removal with various feed pretreatments.

FIG. 3 is a graph showing the catalyst life in pounds catalyst per barrel of feed with various feed pretreatments.

DESCRIPTION OF THE PREFERRED EMBODIMENT

Figure 4:
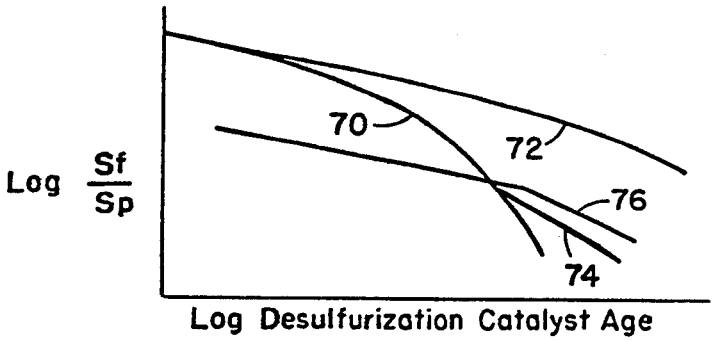
FIG. 4 is a graph showing the desulfurization obtained as a function of catalyst age with porous and non-porous catalysts with and without pretreatment.

FIG. 1 schematically represents a two stage ebullated bed process each stage of which is preferably operated in accordance with the teaching of U.S. Pat. Re. No. 25,770, wherein a liquid phase reaction is accomplished in the presence of a reactant gas and a particulate contact solid under conditions of upflow feeding such that the catalyst or contact solid is maintained in random motion in the liquid and with the removal of liquid effluent substantially free of catalyst or contact solid particles.

More specifically, a high sulfur, high metal content, petroleum residuum in line 10 together with hydrogen at 14 pass upwardly through a reaction zone 16 having a top catalyst solids level at 18. Contact solids are added in line 12.

Solids free liquid is removed at 20 from a suitable trap tray above the contact solids level and a vapor is removed at 22. The vapor which is largely hydrogen and hydrocarbon gases may be suitably treated for recovery of the valuable products and the hydrogen recycled to the reaction zone. The catalyst particles or contact solids are removed from line 24 continuously or otherwise as desired.

As hereinafter described, the pretreatment catalyst or contact solid added at 12 is primarily designed to remove the metals from the feed and the demetalization zone 16 is conveniently operated at relatively low severity conditions of a temperature between about 700° and 825°F, preferably about 780°F and under a pressure between about 1500 and 3000 psig and preferably about 2000 psig. The space velocity is between about 0.10 and 1.00 V/hr/V (volumes of feed per hour per volume of reactor) and preferably about 0.30 V/hr/V.

This pretreatment of the feed in the first stage has been discovered to improve the life of the catalyst in the second stage by a factor that is greater than the amount of metals removed in the first stage. Therefore, a 40 percent metals removal results in a greater than 40 percent increase in the active life of the catalyst.

The liquid effluent leavinng pretreatment zone 16 through line 20 passes to a desulfurization zone 30 with supplemental hydrogen at 34. In a manner similar to the first reaction zone, the liquid and hydrogen pass upwardly through the desulfurization zone 30 and form an ebullated bed with a contact solids level at approximately 36. Contact solids in the form of catalyst are added through line 32. The vapor is removed at 38 and a liquid product removed at 40 from the trap tray 42 above the solids level. The vapor may be treated for recovery of light hydrocarbons and hydrogen, with the hydrogen being purified and recycled to the feed. Catalyst may be removed continuously or otherwise through line 44.

The desulfurization zone is preferably operated at a temperature between 700° and 825°F and at a pressure between 1000 and 3000 psig. In this case the space velocity may be between about 0.50 and 2.50 V/hr/V and preferably in excess of 1.00 V/hr/V.

In accordance with this invention great economics in catalyst use can be accomplished by the use in the first stage zone of a particulate, activated bauxite contact solids which may be activated with a promoter. A typical material would have at least 75 percent alumina and from 7½ to 22 weight percent of promoters of oxides of metals including iron, titanium and silica. More particularly, a commercial product sold under the tradename "Porocel" by Minerals and Chemicals Corporation of America is preferred. This material will have the following composition:

| | Regular | Low Iron | Low Silica |
|---|---|---|---|
| $Al_2O_3$ | 72–76% | 80.5% | 92% |
| $Fe_2O_3$ | 10–18% | 3.0% | 2.5% |
| $TiO_2$ | 4% | 3.5% | 2.5% |
| $SiO_2$ | 5–9% | 11.0% | 2.5% |

-continued

| | Regular | Low Iron | Low Silica |
|---|---|---|---|
| Insolubles | 1% | 2.0% | 0.5% |

No difference in vanadium removal ability was noted among these materials. The oxide promotor may be used alone or in mixtures of $Fe_2O_3$, $TiO_2$, and $SiO_2$. As little as 5 weight percent is effective to activate porous alumina.

The invention is particularly applicable to Venezuelan residuums known as Lago Treco atmospheric bottoms and Tia Juana residuum. Examples of such high vanadium residuums materials are as follows:

TABLE I

| Name | Gravity °API | Sulfur W % | Nickel ppm | Vanadium ppm |
|---|---|---|---|---|
| Bachequero Atmospheric Resid | 10.5 | 3.1 | 100 | 585 |
| Tia Juana Atmospheric Resid | 16.9 | 2.08 | 49 | 255 |
| Tia Juana Vacuum Resid | 8.0 | 2.73 | 89 | 570 |
| Gach Saran Atmospheric Resid | 18.1 | 2.81 | 52 | 140 |
| Khafji Atmospheric Resid | 14.2 | 4.49 | 39 | 100 |
| Lake Medium Atmospheric Resid | 14.1 | 2.3 | 56 | 398 |
| Lago Treco Atmospheric Resid | 17.1 | 2.1 | 39 | 200 |
| Laguna Atmospheric Resid | 11 | 2.9 | 71 | 424 |
| Heavy Lake Atmospheric Resid | 11.2 | 2.8 | 66 | 400 |

In the preferred operation, the contact solids entering the first stage would be in the range of either granules or extrudates of 1/16 inch to 80 mesh size. The extrudates normally have a length at least two times the diameter. Such contat solids have no substantial desulfurization characteristics.

In the second stage, the contact solid is preferably a cobalt molybdenum on alumina catalyst in a close size range from about 1/16 inch to 1/64 inch. It normally costs in excess of one dollar per pound.

With the two stage operation, it is of course possible to continuously replace the contact material and catalyst in the separate reaction zones independently of one another for a most effective operation. However, it is possible to operate both reaction zones in a single reactor inasmuch as the finer contact material will tend to pass up through the coarser contact material, so that there will be a tendency of the activated bauxite to remove the metals and asphaltenes prior to the contact with the more expensive desulfurization catalyst.

The effectiveness of the invention is more fully disclosed in the following explanation of the curves in the figures which are based on operating results.

FIG. 2 shows the effect of pretreatment on the catalyst replacement rate (in pounds of catalyst per barrel of feed) required to reach a particular equilibrium $S_F/S_P$, which is the ratio of the sulfur in the feed to the sulfur in the product. This $S_F/S_P$ value is in effect a relative reaction rate constant. The data clearly show that, with the kind of catalyst selected, the desirable desulfurization levels of 65 percent or more cannot be achieved except at economically prohibitive normal catalyst addition rates. However, using the pretreatment step, curves 52 and 54 with different amounts of different pretreatment agents clearly show that the desired desulfurization levels can be reached. The data shown are at constant catalyst space velocity, pressure, temperature and hydrogen circulation rate; the only difference is the pretreatment operation. Line 54 shows the case of a non-porous desulfurization catalyst where the feed is pretreated with two pounds of Porocel per barrel of feed. Line 52 shows the case of the same catalyst where the feed is pretreated with 0.15 pounds of 5 percent $SiO_2$ on alumina catalyst per barrel of feed. Line 50 shows the case of the same catalyst as above with no feed pretreatment.

FIG. 3 shows the actual deactivation data used to predict the equilibrium desulfurization curves presented in FIG. 2. This data was obtained on the desulfurization of Lago Treco atmospheric residuum having an API gravity of 18, a sulfur content of 2.1 weight percent, 200 ppm vanadium and 30 ppm nickel. The non-porous desulfurization catalyst nis a cobalt molybdate on alumina catalyst whose structure is given later in FIG. 6, Curve 90, and contains about 3 percent CoO and 15 percent $MoO_3$. The desulfurization catalyst is the same for curves 60, 62 and 64. The pretreatment of the feed results in marked improvement on the catalyst life. Curve 62 shows the effect of a pretreatment of the feed and a replacement rate of 0.15lb/bbl of porous alumina catalyst base with 5 percent SiO 2. Curve 64 shows the effect of pretreating with 2 lb/bbl of Porocel. The results in both cases are quite marked and show clearly the dramatic effect of reducing catalyst deactivation compared to curve 60 which shows the use of the desulfurization catalyst without pretreatment. It should be pointed out that the increase in catalyst life is greater than that which would be expected from metals removal only. Some of the other deleterious components in the asphalt fraction of the feed are being removed at the same time that the metals are. Pore plugging occurs probably not only by deposition of the metals on the catalyst surface, but also by the deposition of asphaltenic molecules in the small pores of the high activity catalysts that are desirable in the second stage. The vanadium content going to the second stage as shown by Curve 62 in FIG. 3 is about 125 ppm and that shown by Curve 64 is about 143 ppm. The improvement in deactivation slope here far exceeds that which should be expected from the dimunition in metals content.

The discovery in this invention that catalyst deactivation is controlled by the removal of other materials besides metals is clearly shown by these two examples since the metals removal is about the same. However, the increase in catalyst life is unexpectedly higher using high replacement rates of the contact solids.

TABLE II

Effect of first stage metals removal on second stage catalyst usage rate. (Figure 3).

| | Feed Without First Stage Pretreatment (Line 60) | Feed With First Stage Porocel Pretreatment (Line 64) |
|---|---|---|
| Vanadium in First Stage, ppm | 200 | 200 |
| Vanadium in Second Stage, ppm | 200 | 140 |
| Catalyst Age to Reach Fixed Desulfurization Percent | | |
| 50% | 1.8 bbl/lb | 9.9 bbl/lb |
| 60% | 1.5 bbl/lb | 8.9 bbl/lb |
| 70% | 1.2 bbl/lb | 5.3 bbl/lb |

TABLE II-continued

Effect of first stage metals removal on second stage catalyst usage rate. (Figure 3).

| | Feed Without First Stage Pretreatment (Line 60) | Feed With First Stage Porocel Pretreatment (Line 64) |
|---|---|---|
| 80% | 0.8 bbl/lb | 1.6 bbl/lb |

Table II clearly shows that the treatment of the feed in the first stage improves the performance of the catalyst in the second stage by a factor that is greater than the amount of metals removed on the first stage.

Figure 6:
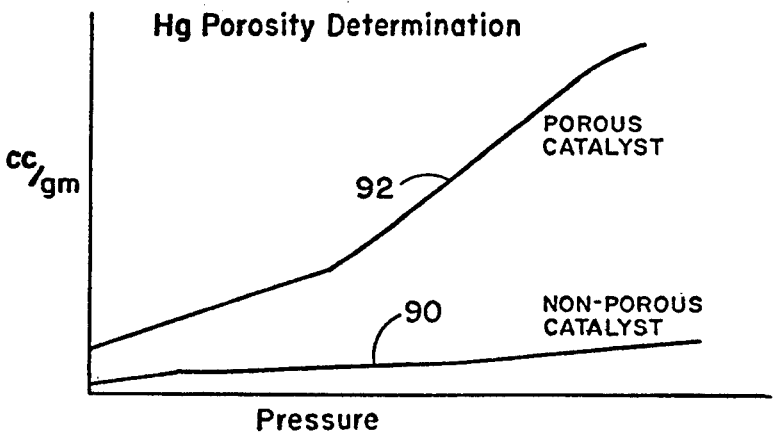
FIG. 6 is a graph showing the pore size distribution of porous and non-porous catalysts.

In FIG. 4, desulfurization curves are presented for desulfurization of the Lago Treco atmospheric resid with the non-porous desulfurization catalyst as mentioned before and a porous desulfurization catalyst whose pore size distribution is indicated by Curve 92 in FIG. 6. The metals contents of both catalyst are approximately the same, 3 percent CoO and 15 percent $MoO_3$. Curve 72 shows the results of catalyst aging using a non-porous desulfurization catalyst with pretreatment of the feed, while Curve 70 shows the results when using a non-porous desulfurization catalyst with no pretreatment of the feed. Curve 76 shows the results of catalyst aging using a porous desulfurization catalyst with pretreatment of the feed, while Curve 74 shows the results when using a porous catalyst without pretreating the feed. Comparing Curves 70 and 74, which are the non-pretreatment cases, after a fairly short on-stream time the non-porous, the high activity type catalyst rapidly deactivates and becomes poorer than the porous catalyst which starts at a much lower initial activity. However, Curve 72 which shows the effect of pretreatment clearly shows that the effect on the high activity catalyst is quite dramatic while the effect shown for Curve 76 which is the porous catalyst with pretreatment has almost no improvement or, at best, a small increase in the useful catalyst life. These curves show that the desired desulfurization of 65 to 80 percent on the Venezuelan residuum can be obtained by use of the proper amount of pretreatment and a non-porous high activity catalyst.

Figure 5:
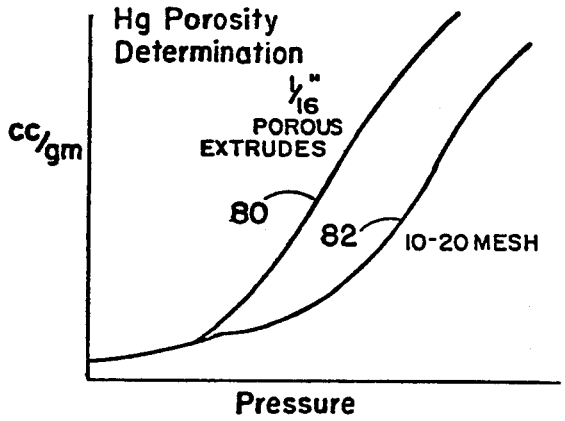
FIG. 5 is a graph showing the pore size distribution of two different first stage absorbents.

The pore size distribution of the first stage material is shown in FIG. 5 where Curve 80 is alumina with 5 percent SiO 2 and Curve 82 is Porocel, and the second stage material is shown in FIG. 6 where Curve 92 is the porous catalyst and curve 90 is the non-porous catalyst. As shown in FIG. 6 a desired catalyst for the second stage has less than 0.10 cc/gram in pores larger than 250A.

Figure 7:
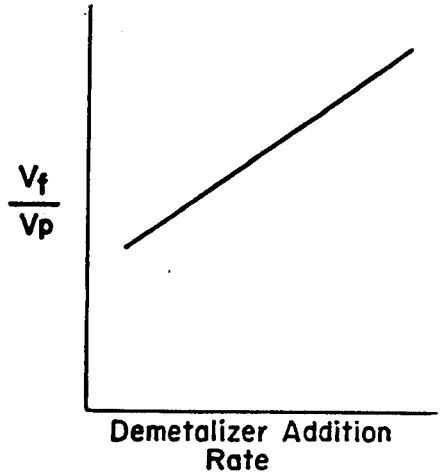
FIG. 7 is a graph showing the effect of rate of addition of demetalizer catalyst on metals removal from the feed.

FIG. 7 shows the tremendous effect of increasing Porocel addition rates on vanadium removal. This amount of solids addition and withdrawal is only feasible in an ebullating bed reactor system.

The pretreatment with the porous alumina contact solids removes the vanadium and nickel contained in the asphaltenes in the feed and thereby the catalyst utilization needed to effect 65 to 80 percent desulfurization is much lower. The catalyst requirement is lowered by a larger factor than the change in amount of metals removed. Thus effectively 50 percent metals removal results in less than one half of the catalyst replacement rate heretofore required without pretreatment.

One of the major advantages in using the ebullated bed system is that a granular material can be used in the first stage as a demetalization contact solids. This material can have a fairly wide size distribution since there are no restrictions as would be found in a normal fixed bed operation where the size and shape of the particles must be large and regular, respectively. In this case, the use favors vanadium removal. Of course, regular exruded contact solids can be utilized as shown by some of the data, but these are of higher cost than materials which are essentially recovered from natural materials by calcining.

Many modifications of the illustrative embodiment of the invention will occur to those skilled in the art. In view of the various modifications of the invention which may be made without departing from the spirit or scope thereof, only such limitations should be imposed as are indicated by the appended claims.

We claim:

1. In a hydrodesulfurization process wherein a metal- and sulfur-containing petroleum liquid residuum feedstock is treated in a hydrodesulfurizing step by feeding the residuum together with hydrogen upwardly into a desulfurization reaction zone maintained under ebullated bed hydrodesulfurization conditions with a temperature between about 700° and about 825°F and a pressure between about 1000 and about 3000 psig, while maintaining in said desulfurization zone a high density, substantially non-porous particulate solid catalyst selected from the group consisting of cobalt molybdate on alumina and nickel molybdate on alumina in random motion in the liquid, said catalyst having a porosity not greater than 0.1 cc/g of cumulative pore volume for pores having diameters larger than 250A to recover a reiduum containing less than one percent sulfur;

the improvement which comprises:

pretreating the metal-containing residuum before substantial desulfurization to remove vanadium or nickel by feeding said residuum with a hydrogen-containing gas to a pretreatment zone maintained at a temperature between about 700° and 825°F and a pressure between 1000 and 3000 psig;

maintaining in said pretreatment zone a bed of particulate contact solids containing at least 75 weight percent porous alumina and containing about 7½ to 22 weight percent metal oxide promoter consisting essentially of a mixture of $Fe_2O_3$, $TiO_2$ and $SiO_2$, and mixtures thereof;

feeding said contact solids to the reaction zone at a rate sufficient to achieve at least 40 percent removal of vanadium, said contact solids being maintained in random motion in the liquid by the residuum feed and hydrogen-containing gas, whereby the desulfurization catalyst has increased life and sulfur removal is enhanced.

2. The process of claim 1 wherein more than 65 percent of the sulfur in the feedstock is removed; wherein the feedstock before pretreatment contains at least 100 ppm vanadium.

3. In a hydrodesulfurization process wherein a metal- and sulfur-containing petroleum liquid residuum feedstock is treated in a hydrodesulfurizing step by feeding the residuum together with hydrogen upwardly into a desulfurization reaction zone maintained under ebullated bed hydrodesulfurization conditions with a temperature between about 700° and about 825°F and a pressure between about 1000 and about 3000 psig, while maintaining in said desulfurization zone a high density, substantially non-porous particulate solid catalyst selected from the group consisting of cobalt molybdate on alumina and nickel molybdate on alumina in random motion in the liquid, said catalyst having a porosity not greater than 0.1 cc/g of cumulative pore volume for pores having diameters larger than 250A to recover a residuum containing less than one percent sulfur;

the improvement which comprises:

pretreating the metal-containing residuum before substantial desulfurization to remove vanadium or nickel by feeding said residuum with a hydrogen-containing gas to a pretreatment zone maintained at a temperature between about 700° and 825°F and a pressure between 1000 and 3000 psig;

maintaining in said pretreatment zone a bed of particulate contact solids consisting essentially of porous alumina and containing about 5 weight percent $SiO_2$ promoter;

feeding said contact solids to the reaction zone at a rate sufficient to achieve at least 40 percent removal of vanadium, said contact solids being maintained in random motion in the liquid by the residuum feed and hydrogen-containing gas, whereby the desulfurization catalyst has increased life and sulfur removal is enhanced.

4. The process of claim 3 wherein more than 65 percent of the sulfur in the feedstock is removed; wherein in the feedstock before pretreatment contains at least 100 ppm vanadium.

* * * * *